United States Patent [19]

Cummings et al.

[11] Patent Number: 4,930,274

[45] Date of Patent: Jun. 5, 1990

[54] SKYLIGHT FRAME AND PANEL ASSEMBLY

[76] Inventors: Peter A. Cummings, 655 Pine St., Harbor Springs, Mich. 49740; Ronald E. Sears, 860 Helston, Bloomfield Hills, Mich. 48013

[21] Appl. No.: 331,667

[22] PCT Filed: Apr. 4, 1987

[86] PCT No.: PCT/US87/00827

§ 371 Date: Jan. 9, 1989

§ 102(e) Date: Jan. 9, 1989

[87] PCT Pub. No.: WO88/08062

PCT Pub. Date: Oct. 20, 1988

[51] Int. Cl.[5] ..... E04B 7/18

[52] U.S. Cl. ..... 52/200; 52/213

[58] Field of Search ..... 52/200, 72, 213, 397

[56] References Cited

U.S. PATENT DOCUMENTS

| | | |
|---|---|---|
| 412,313 | 10/1889 | Weis et al. . |
| 540,821 | 6/1895 | Smith . |
| 764,965 | 7/1904 | Tousley . |
| 1,211,053 | 1/1917 | Bernard . |
| 2,182,852 | 12/1939 | Mulford . |
| 3,325,951 | 6/1967 | Johnson . |
| 3,983,669 | 10/1976 | Bogaert . |
| 4,173,854 | 11/1979 | Wallerstein . |
| 4,190,987 | 3/1980 | Naidus . |
| 4,193,237 | 3/1980 | Jankowski . |
| 4,194,498 | 3/1980 | Mayerovitch . |
| 4,589,239 | 5/1986 | Cummings . |

FOREIGN PATENT DOCUMENTS

| | | | |
|---|---|---|---|
| 74858 | 10/1952 | Denmark . | |
| 0085632 | 8/1983 | European Pat. Off. | 52/200 |
| 2142733 | 7/1978 | Fed. Rep. of Germany . | |

*Primary Examiner*—Carl D. Friedman

*Attorney, Agent, or Firm*—Ralph M. Burton

[57] ABSTRACT

A skylight frame (20) and panel (70) assembly comprises a box-like frame 20 having panel receiving channels (54, 56) for slidably receiving a trough-shaped translucent panel (70) having a downturned flange 74, the frame being receivable in an opening in the roof with a drip molding underlying the roof shingles and overlying the joint line between the frame (20) and roof opening and also covering the exposed joint between the frame (20) and the panel (70).

5 Claims, 5 Drawing Sheets

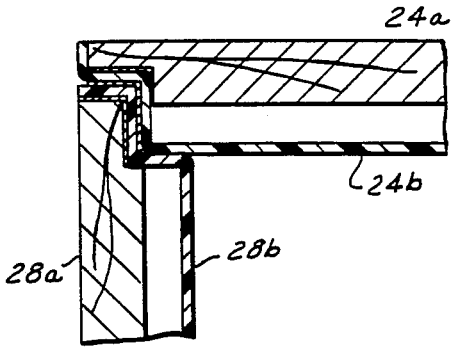
FIG. 8
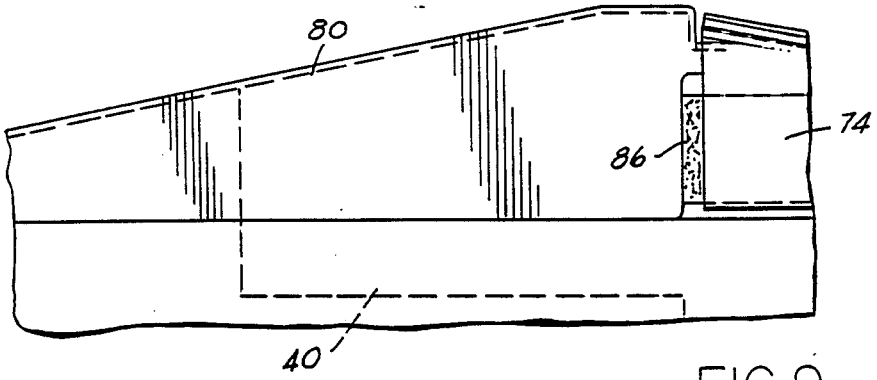
FIG. 9
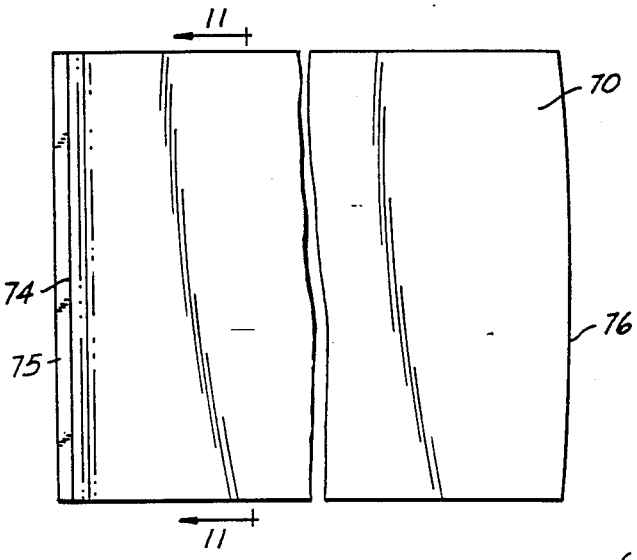
FIG. 10
FIG. 11
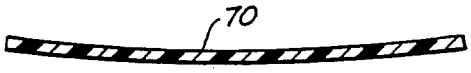

SKYLIGHT FRAME AND PANEL ASSEMBLY

FIELD OF INVENTION

This invention relates to a skylight frame and panel assembly for mounting in an aperture in a sloping roof.

This disclosure incorporates by reference U.S. Pat. No. 4,589,239 dated May 20, 1986.

BACKGROUND OF INVENTION

This invention represents improvements in the disclosure set forth in U.S. Pat. No. 4,589,239 which shows the basic concept of the skylight. Production considerations and the desire to reduce costs and simplify installation of the skylight in the roof aperture combined to create problems in how best to utilize the teachings of U.S. Pat. No. 4,589,239.

SUMMARY OF THE INVENTION

The foregoing considerations have led to the development of an improved structure retaining the basic teachings of U.S. Pat. No. 4,589,239 but permitting improvements in ease of production, installation in a roof aperture, reduction in costs and further safeguards against the entry of moisture through or around the skylight. This is accomplished by constructing the skylight frame of header, side and bottom rails having different lengths but uniform heights at their ends whereby a plurality of different size skylight frames can be produced with but a few different length rails. Exposed surfaces and gaps are covered by vacuum formed plastic coverings which also serve to define skylight panel receiving channels and seal seats. Roofing nail impervious barrier strips protect skylight panel receiving channels from roofers inadvertently nailing thereinto, and the translucent skylight panel is held in its trough-like shape by an intregal flange at one end of the panel. The panel is held is place by a releasable fastener disposed between the flange and the skylight frame.

BRIEF DESCRIPTION OF THE DRAWINGS

FIG. 8 is a cross-sectional view taken on the line 8—8 of FIG. 6;

FIG. 9 is an end view taken on the line 9—9 of FIG. 2; and

FIGS. 10 and 11 are plan views of the skylight panel.

BRIEF DESCRIPTION OF THE PREFERRED EMBODIMENTS

Figure 1:
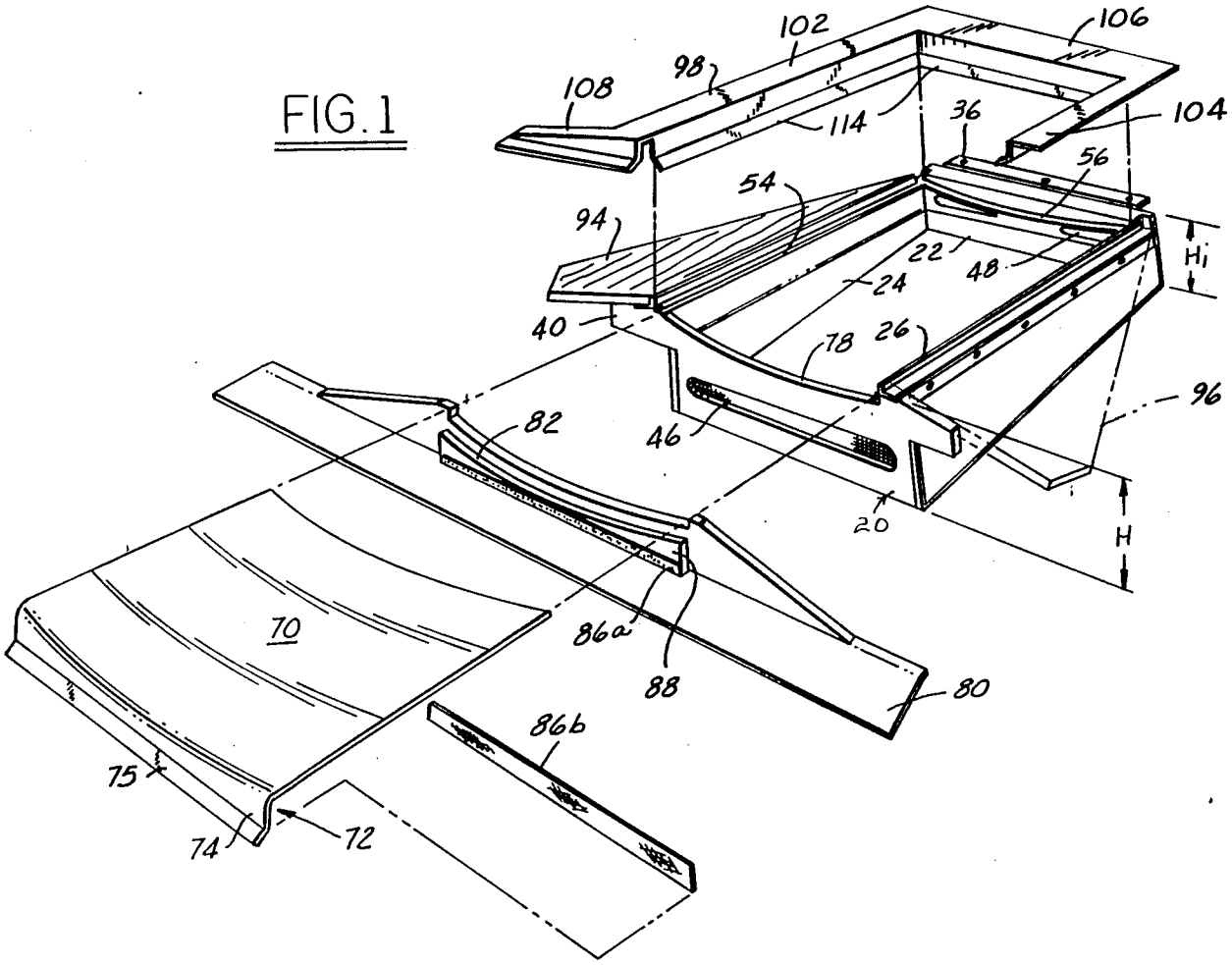
FIG. 1 is a perspective exploded view of a skylight frame and panel assembly emboding the invention.
Figure 2:
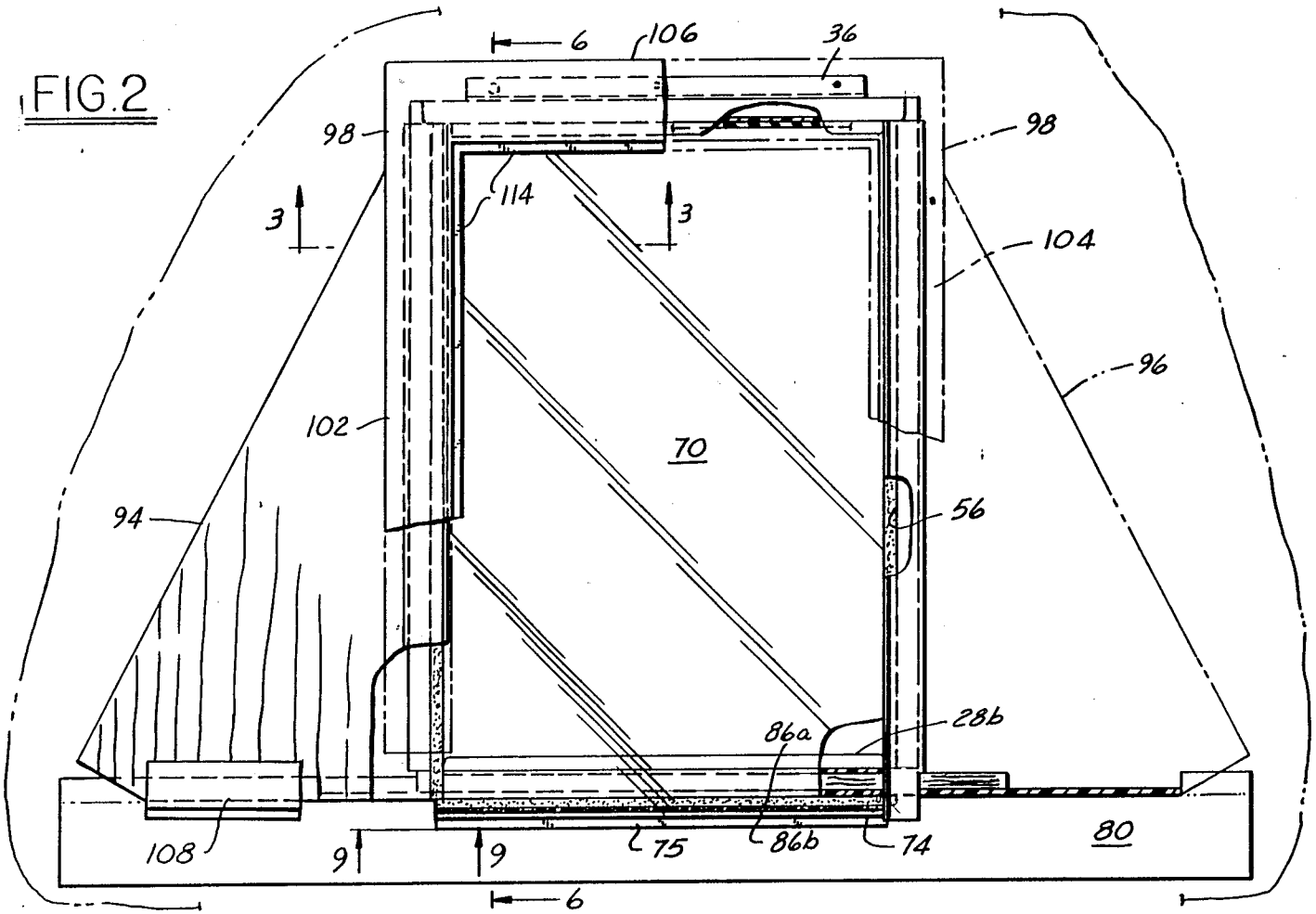
FIG. 2 is a plan view of the assembly shown in FIG. 1 with certain parts broken away for clarity.
Figure 4:
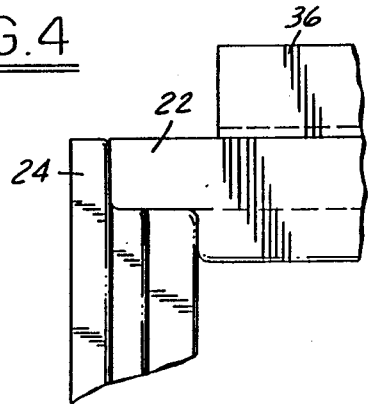
FIG. 4 is a plan view through a corner between the header and a side rail with certain parts removed for clarity, taken in the direction of arrows 4—4 of FIG. 3.
Figure 5:
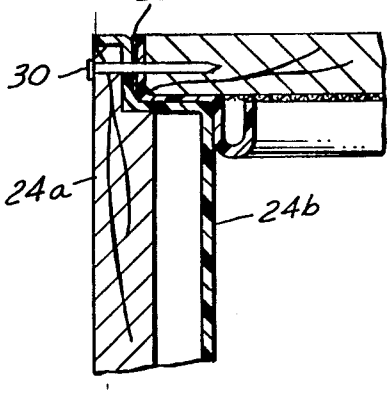
FIG. 5 is a cross-sectional view taken on the line 5—5 of FIG. 3.

As shown in FIG. 1 the improved skylight frame and panel assembly comprising a generally rectangular, box-like frame 20 having header 22, sides 24 and 26 and bottom rails 28 which are secured together at their corners by fasteners 30 and adhesive 32 (see FIG. 5). The frame members may be formed of plastic or other suitable materials, or by a combination of wood and plastic. As shown in FIGS. 3, 5, 6 and 8, the frame members comprise a wooden structural part identified with a suffix identification (a) which is covered by a formed plastic layer identified by the suffix identification (b). This plastic layer may be vacuum formed to mate or nest with the underlying wooden frame, and covers and conceals the wood protecting it from weathering and also providing an attractive and tough surface that may be painted if desired. ABS polymers will be suitable for this purpose. The frame is received in a roof aperture provided in the roof structure. The aperture may be framed up between roof rafters, one of which shown in phantom outline at 34 in FIG. 3, and the skylight frame is hung in the aperture upon an angle bracket 36 (see FIGS. 1, 2 and 6) and the projecting ends 38 and 40 of the bottom rail 28. The angle bracket 36 is secured to the header by fasteners 42 and overlies the roof boards 44 adjacent the header end of the aperture and is nailed thereto as shown. The projecting ends 38 and 40 rest on the roof boards and may be nailed thereto.

The header and bottom rail members are provided with vent apertures 46 and 48 covered by an insect excluding screen 50. These vents enable air beneath the roof boards to circulate through the skylight space encompassed by the frame 20.

The construction of this frame 20 is such that a variety or series of different size frames may be provided with but a few different length rails. For example, with three different length headers and cooperating length bottom rails, and three different length pairs of side rails, 9 different size skylight frames may be produced. This is possible because of the fact that the two different heights H and $H_1$ of the ends of the headers, side rails and bottom rails are uniform even though their lengths may vary.

Figure 3:
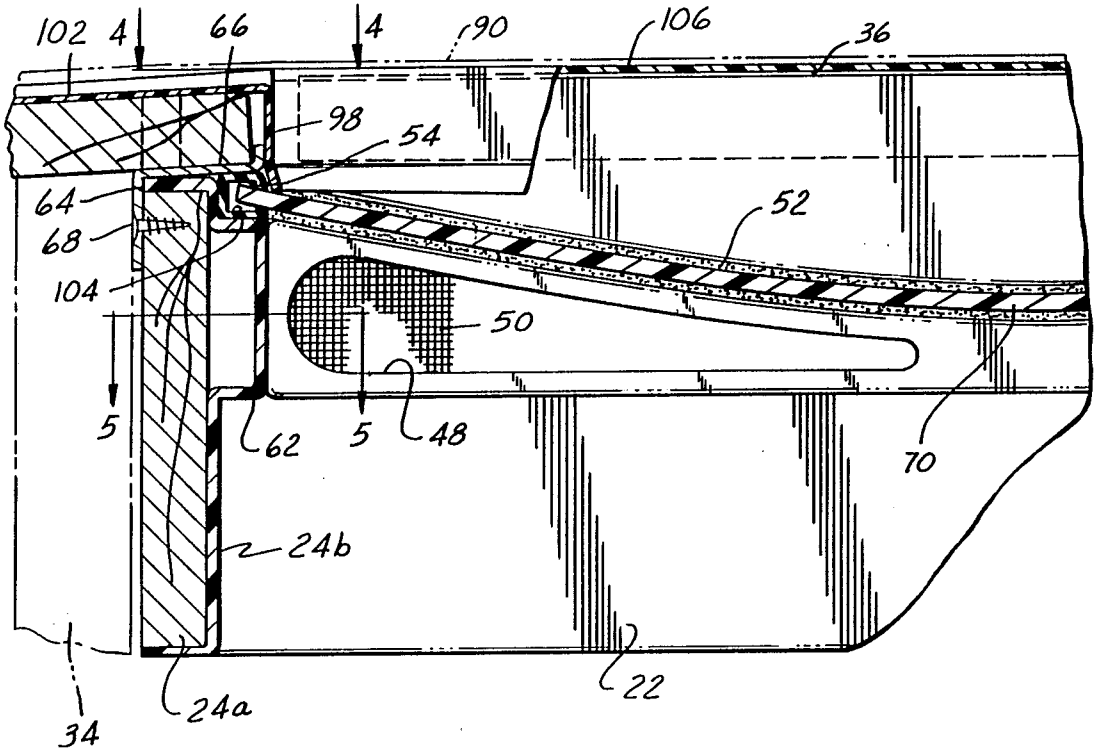
FIG. 3 is a cross-sectional view taken on the line 3—3 of FIG. 2.

The header 22 and side rails 24 and 26 are provided with inwardly-opening skylight panel receiving channels 52, 54 and 56 which are aligned at the intersecting corners of the side rails and header as best shown in FIG. 3. The channel 52 in the header is formed by a transverly bow shaped recess that extends lengthwise of the header and is formed in the plastic layer **22*b* between abutments 58 and 60. The channels 54 and 56 in the side rails are similar, and that shown in FIG. 3 will suffice for both. The channel 54 is formed by an abutment shoulder 62 in the plastic layer 24*b* and an overlying stiffening and roofing nail impervious barrier strip 64 of generally Z-shaped configuration having one leg 66 disposed spaced above the abutment shoulder. Suitable fasteners 68 secure the barrier strip in place as shown. The strip is formed of galvanized steel or the like and prevents roofing nails from being inadvertently driven down into the channels 54 and 56 in the side rails, as the roofers fasten roof covering peripherally adjacent the skylight frame. The strips also serve to re-enforce the side rails between the header and bottom rails. The channels 54 and 56 in the side rails follow the slope of the upper edge of the side rails and thus lie at an acute angle to the plane of the header rail as best shown in FIG. 1**.

A translucent skylight panel 70 of longitudinal trough-like configuration is slideably received in the channels 52, 54 and 56 of the frame. While characterized as translucent, it is to be understood that as used herein the term "translucent" is also intended to include transparent. The panel may be formed of a thermo-plastic material such as methyl methacrylate (Plexiglas) or butyrate or a polycarborate such as Lexan being examples. The panel is held in its trough-like shape before insertion into the frame at the bottom rail end 72 by a flange 74 having an out-turned lip 75. During manufacture of the panel a flat sheet of the plastic heated at the end 72 to a forming temperature, is deflected to the trough-shape and while in such shape the flange 74 is bent down. The plastic is cooled and the flange 74 will cause the panel to retain the trough-shape. The opposite end 76 of the panel is formed when the panel is flat with a convex radius as shown in FIG. 10 and when the panel is then inserted in the frame channel the end 76 will enter the channel 52 and-nest therein as though the edge 76 was straight, by virtue of the trough-shape of the panel and its angled relation with the plane of the header.

Figures 6, 7:
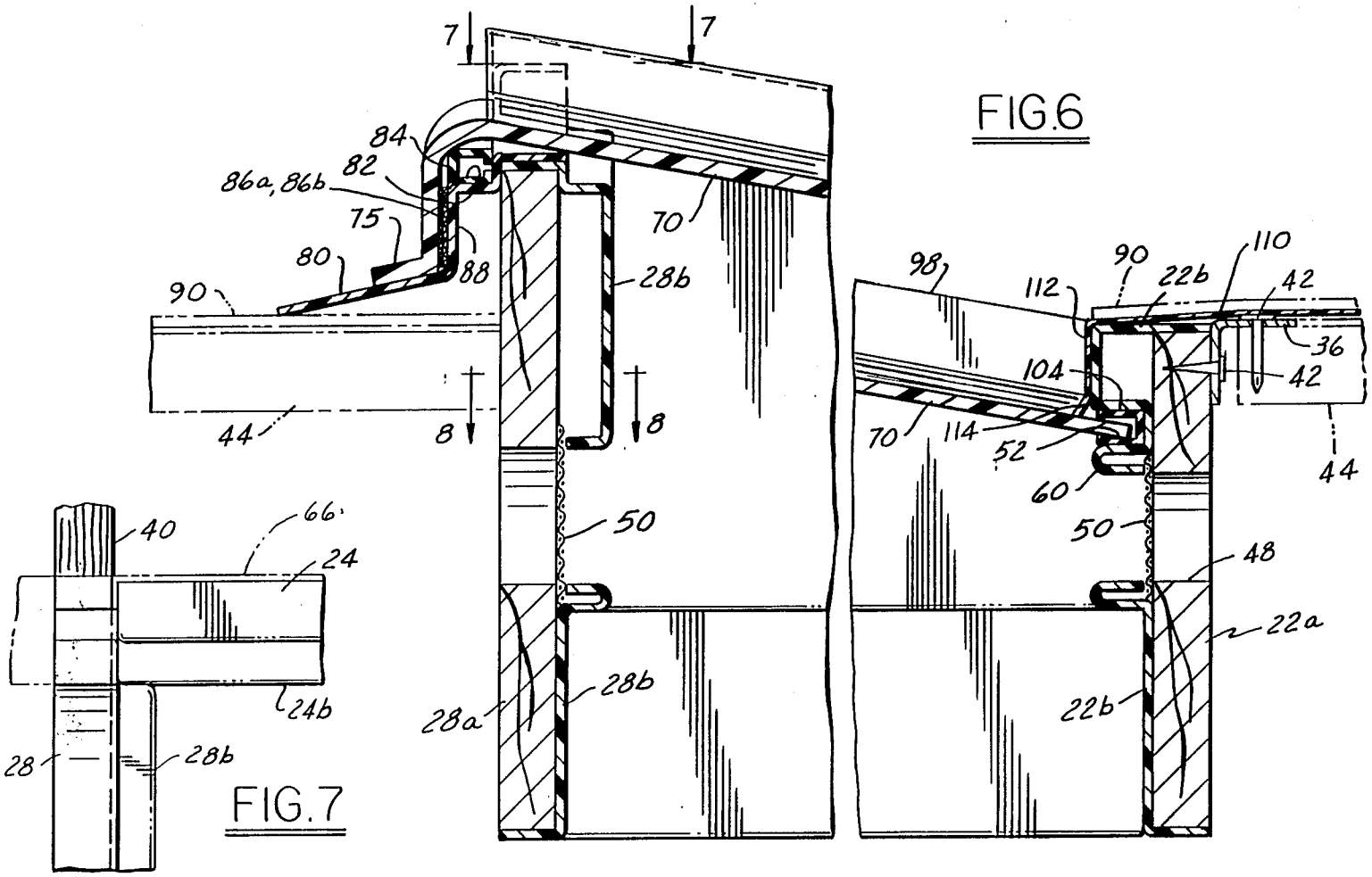
FIG. 6 is a cross-sectional view taken on the line 6—6 of FIG. 2.
FIG. 7 is a plan view through a corner between the bottom rail and a side rail with parts removed for clarity, taken substantially on the line 7—7 of FIG. 6.

The upper edge 78 of the bottom rail is concave to match the trough-shape of the panel and a plastic skirt 80 overlies the bottom rail as best shown in FIGS. 1 and 6 and provides a seat 82 for a C-shaped resilient seal 84 that engages the underside of the skylight panel. The panel is releasably held in place in the frame by a hook and loop fabric connector 86 such as Velcro, one portion 86*a* of which is secured to the skirt 80 and the cooperating opposed portion 86*b* to the confronting flange 74. The skirt 80 is shaped to provide an abutment 88 that serves as a seat 82 for the seal 84, and the skirt overlies the roof covering such as shingles 90, an underlying vapor barrier 92 and the roof boards 44.

It will be noted that the skirt 80 is shaped to overlie the projections 38 and 40 of the bottom rail and underlie the generally triangularly shaped flaring pieces 94 and 96. These flaring pieces also overlie the barrier strips 94 as best shown in FIG. 3 and fasteners (not shown) are projected down through the flaring pieces and into the side rails to secure the flaring pieces thereto. These flaring pieces provide a transition between the roof boards which they overlie and the upper edge of the frame exposed above the roof aperture. A polyethylene drip molding 98 of U-shaped configuration in plan view as shown in FIGS. 1 and 3 overlies the flaring pieces 94 and 96, the side rails 24 and 26, the header rail 22 and the skirt 80. For this purpose the drip molding has side portions 102 and 104, a header portion 106 and laterally projecting wings, only one of which is shown at 108. The wings overlie the skirt 80. The drip molding has a horizontal leg 110, a vertical leg 112 and an angled lip 114 as best shown in FIG. 6. The horizontal leg underlies the roof shingles 90 and overlies the joint between the frame 20 and the roof opening into which the frame is received. The vertical leg covers and conceals the otherwise exposed edges of the joints between the translucent panel and the side and header rails. The lip 114 terminates closely adjacent or in contact with the skylight panel 70 and the skirt 80. Thus the drip molding serves to finish off and protect all the exposed joints to prevent the entry of rain, snow and the like thereinto.

The roof covering, such as shingles, overlies the flaring pieces 94 and 96 and the skirt 80 serves to bridge the gap at the bottom rail of the skylight frame between shingles overlying the flaring pieces and the shingles at 90 shown in FIG. 6.

To seal the skylight panel in the frame along the side rails and header, C-shaped flexible seal strips 104 of the same character as strip 84, embrace the marginal edges of the panel received in the channels as shown in FIGS. 3 and 6. By embracing the panel, the sealing strips allow for expansion and contraction of the panel while maintaining the panel sealed in the channels.

The translucent panel 70 is intended to be slidingly received in the skylight frame and may be withdrawn therefrom for replacement. With the flange 74 secured to the bottom rail 28 by the fastener 86, upon heating and cooling of the panel it will expand and contract and the resiliency of the C-shaped seals will permit the panel to come and go in the channels 52, 54, and 56 while maintaining a seal between the panel and the frame.

I claim:

1. A skylight frame and panel assembly for mounting in a roof aperture comprising, in combination:

a generally rectangular box-like frame having a header, side and bottom rails, with the side and header rails having inwardly opening skylight panel receiving channels;

means for overlying the roof margins adjacent the aperture to support the frame therein including portions of the bottom rail projecting laterally beyond the side rails;

a flexible skirt overlying the bottom rail and the projecting portions thereof for extending over the roof;

laterally extending generally triangularly shaped flaring pieces overlying the side rails and said skirt for extending over the roof and beneath the roof covering;

roofing nail impervious barrier strips extending along the side rails above said channels to prevent penetration of the channels by roofing nails during covering of the flaring pieces by a roof covering;

a translucent panel slideably received in said channels; and resilient gasket means extending along said channels and along said bottom rail for sealing the panel in the frame.

2. The invention defined by claim 1 wherein said channels in the side rails extend longitudinally of the side rails and are disposed at an acute angle to the header.

3. The invention defined by claim 1 wherein means defining a drip edge overlie the side and header rails and the translucent panel thereadjacent.

4. In a skylight assembly having a frame for mounting in a aperture through the roof of a building to underlie the roof covering marginally adjacent the aperture, and wherein the frame has opposed channels for slideably supporting the lateral margins of a translucent panel for removal or replacement thereof, the invention characterized by roofing nail impervious barrier strips extending along opposite sides of said frame above said channels and intended to underlie the roof covering and prevent penetration into said channels of roofing nails driven through roof covering marginally adjacent the aperture.

5. The invention defined by claim 4 wherein said strips form a wall of the opposed channels for slideably receiving the panel.

* * * * *